US007448936B1

(12) United States Patent
Kemp-Dorsey

(10) Patent No.: US 7,448,936 B1
(45) Date of Patent: Nov. 11, 2008

(54) NURSING BRA ASSEMBLY

(76) Inventor: Louise Kemp-Dorsey, 163 Hampton Shores Dr., Hampton, GA (US) 30228

( * ) Notice: Subject to any disclaimer, the term of this patent is extended or adjusted under 35 U.S.C. 154(b) by 0 days.

(21) Appl. No.: 11/672,697

(22) Filed: Feb. 8, 2007

(51) Int. Cl.
*A41C 3/00* (2006.01)

(52) U.S. Cl. ..... 450/36; 450/37; 450/54

(58) Field of Classification Search ..... 450/36–38, 450/54–58; 604/385.07
See application file for complete search history.

(56) References Cited

U.S. PATENT DOCUMENTS 623,413 A * 4/1899 Murray ..... 450/36
4,222,387 A * 9/1980 Tetu ..... 450/36
4,335,728 A * 6/1982 Fildan ..... 450/36
5,679,052 A 10/1997 Rucki
5,839,942 A 11/1998 Miller
6,241,715 B1 6/2001 Houser et al.
6,394,879 B1 5/2002 Paige
6,464,717 B1 10/2002 Smith et al.
6,659,841 B2 * 12/2003 Raimondo ..... 450/36
6,821,185 B1 * 11/2004 Francis ..... 450/36

FOREIGN PATENT DOCUMENTS

DE 243722 3/1977

* cited by examiner

*Primary Examiner*—Gloria Hale

(57) ABSTRACT

A nursing bra assembly for securing pads in a nursing bra to inhibit the pads inadvertently falling out includes a bra for covering a pair of breasts and a portion of the torso of a person. The bra includes a pair of cups. Each of the cups has a feeding aperture extending therethrough and at least one nipple of the associated one of the breasts is accessible through the cup to be suckled by an infant. Each of the cups of the bra has one of a pair of covers pivotally coupled thereto. Each of the covers is selectively pivoted over the feeding aperture in the associated one of the cups. Each of the covers has one of a pair of pockets coupled thereto. The pockets are positioned over and adjacent to the feeding aperture of the cups when the covers are positioned over the feeding aperture.

5 Claims, 3 Drawing Sheets

NURSING BRA ASSEMBLY

BACKGROUND OF THE INVENTION

1. Field of the Invention

The present invention relates to nursing bras and more particularly pertains to a new nursing bra for securing pads in a nursing bra to inhibit the pads inadvertently falling out or shifting which could lead to leakage.

2. Description of the Prior Art

The use of nursing bras is known in the prior art. While these devices fulfill their respective, particular objectives and requirements, the need remains for a system that has certain improved features that surrounds a pad on all sides to inhibit the pad from falling out. Additionally, the system compresses the pad to retain the pad in the desired position.

SUMMARY OF THE INVENTION

The present invention meets the needs presented above by generally comprising a bra for covering a pair of breasts and a portion of the torso of a person. The bra includes a pair of cups. Each of the cups covers a portion of an associated one of the breasts. Each of the cups has a feeding aperture extending therethrough, wherein at least a nipple of the associated one of the breasts is accessible through the cup to be suckled by an infant. Each of the cups of the bra has one of a pair of covers pivotally coupled thereto. Each of the covers is selectively pivoted over the feeding aperture in the associated one of the cups. Each of the covers has one of a pair of pockets coupled thereto. The pockets are positioned over and adjacent to the feeding aperture of the associated one of the cups when the covers are positioned over the feeding aperture.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the clams annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
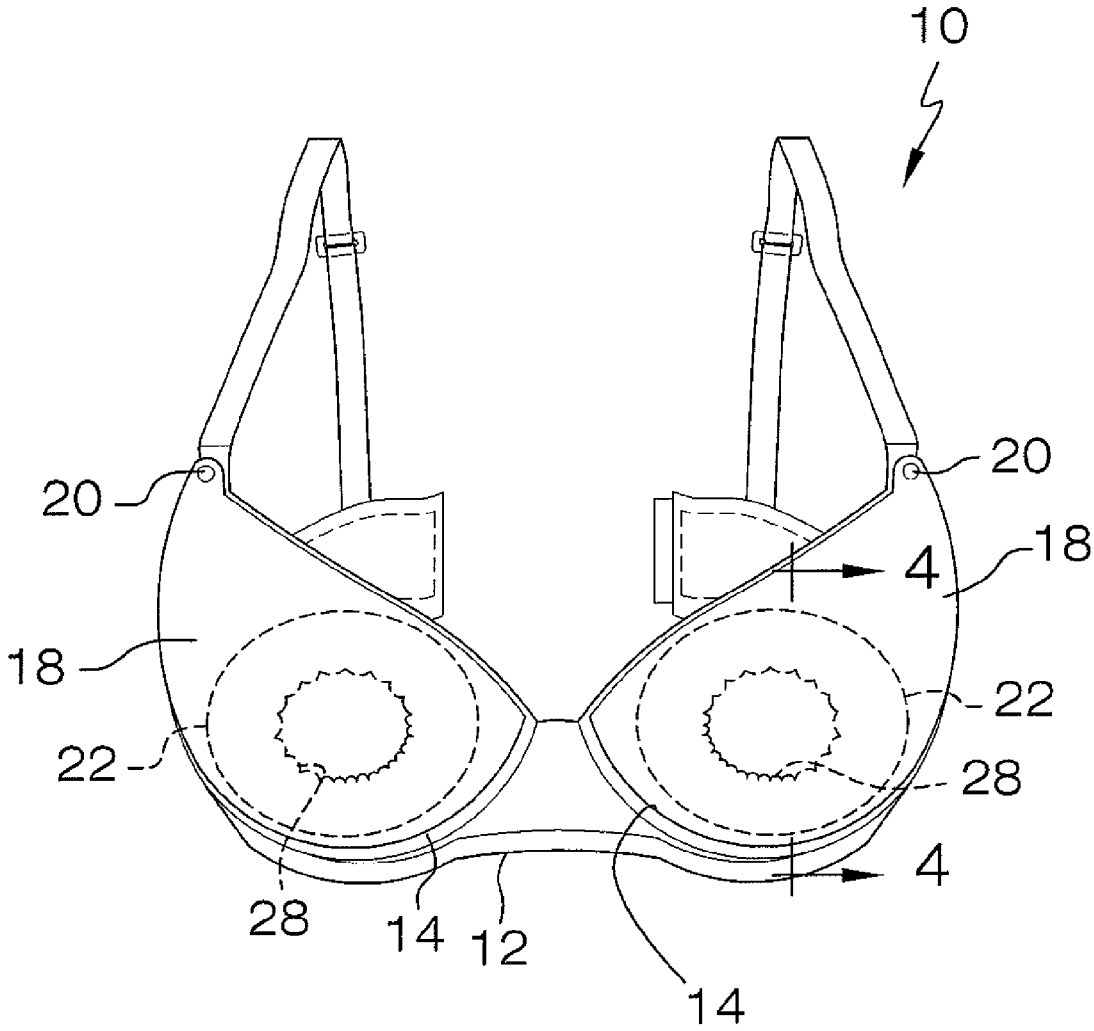
FIG. 1 is a front view of a nursing bra assembly according to the present invention.
Figure 2:
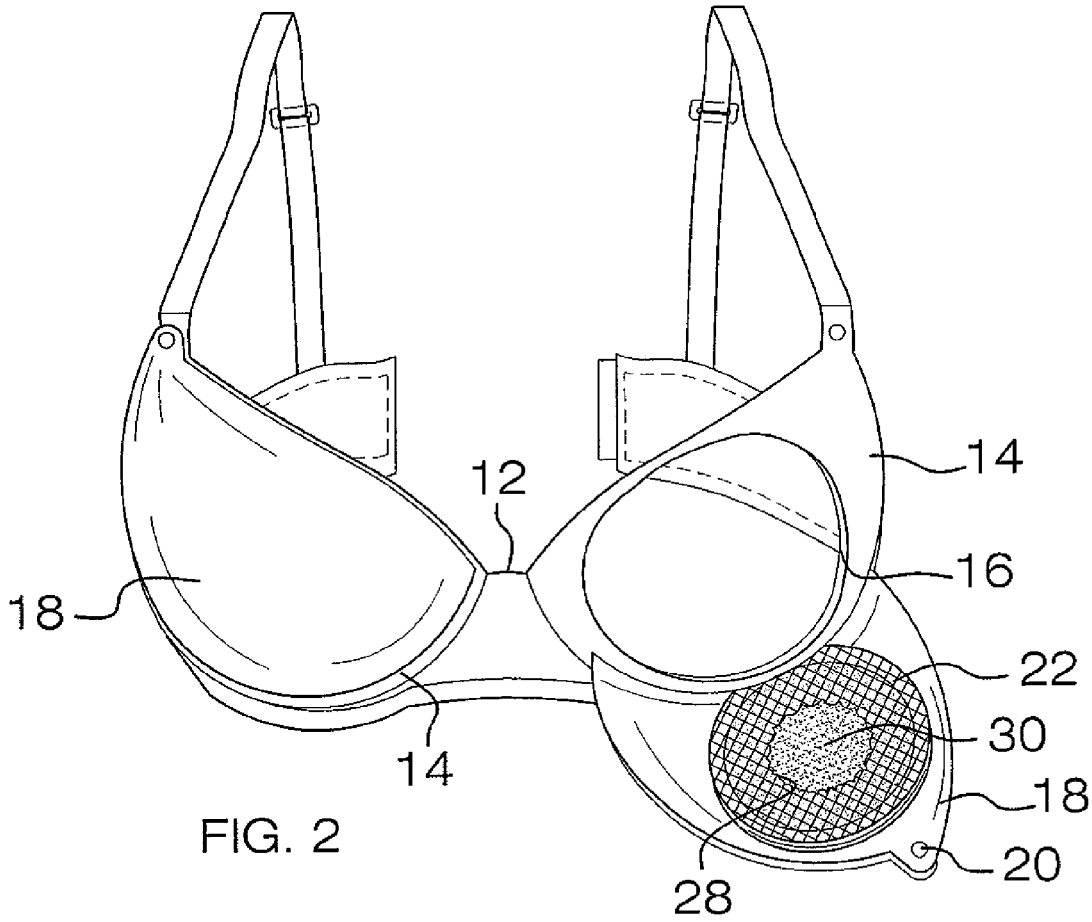
FIG. 2 is a front view of the present invention showing one of the covers pivoted away from one of the cups.
Figure 3:
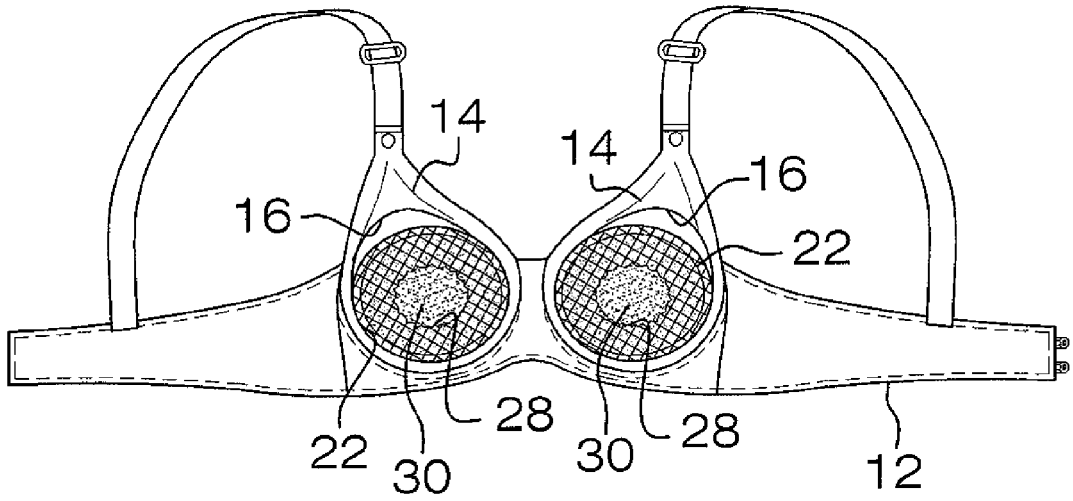
FIG. 3 is a rear view of the present invention.
Figure 4:
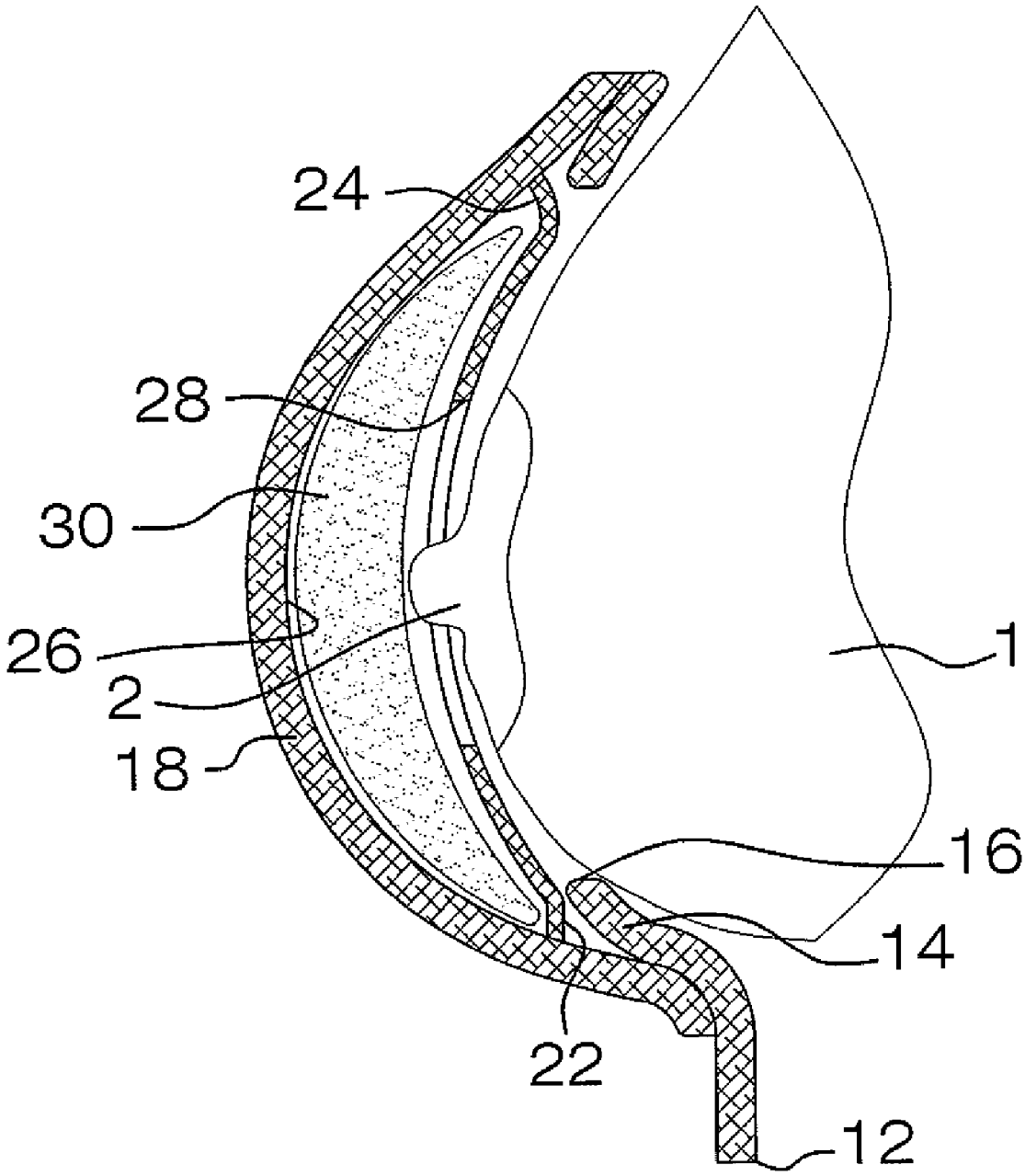
FIG. 4 is a cross-sectional view of the present invention taken along line 4-4 of FIG. 1.

With reference now to the drawings, and in particular to FIGS. 1 through 4 thereof, a new nursing bra embodying the principles and concepts of the present invention and generally designated by the reference numeral 10 will be described.

As best illustrated in FIGS. 1 through 4, the nursing bra assembly 10 generally comprises a bra 12 for covering a pair of breasts 1 and a portion of a torso of a person. The bra 12 includes a pair of cups 14. Each of the cups 14 covers a portion of an associated one of the breasts 1. Each of the cups 14 has a feeding aperture 16 extending therethrough, wherein at least a nipple 2 of the associated one of the breasts 1 is accessible through the cup 14 to be suckled by an infant.

The cups 14 of the bra 12 each have one of a pair of covers 18 pivotally coupled thereto. The covers 18 are selectively pivoted over the feeding aperture 16 in the associated one of the cups 14. Each of the covers 18 includes a securing member 20 configured to secure the covers 18 over an associated one of the feeding apertures 16.

Each of the covers 18 has one of a pair of pockets 22 coupled thereto. The pockets 22 are positioned over and adjacent to the feeding aperture 16 of the associated one of the cups 14 when the covers 18 are positioned over the feeding aperture 16. A peripheral edge 24 of each of the pockets 22 is coupled to an interior face 26 of the associated one of the covers 18. The pockets 22 each have an approximately centrally disposed insertion aperture 28 extending therethrough.

Each of a pair of pads 30 is removably positioned in one of the pockets 22 and is aligned with one of the feeding apertures 16. Each of the pads 30 may be comprised of an absorbent material to absorb lactations from the nipple 2. Each of the pads 30 may also be comprised of a cooling material to cool the nipple 2 abutting the pads 30. The insertion aperture 28 permits one of the pads 30 to be inserted between the associated one of the pockets 22 and the associated one of the covers 18 to maintain positioning of the associated one of the pads 30. Each of the pockets 22 is comprised of an elastic mesh material to permit each of the insertion apertures 28 to expand to receive one of the pads 30 and the pockets 22 to compress the pad 30 against the covers 18. The insertion aperture 28 permits the nipple 2 of the associated one of the breast 1 to extend through the associated one of the pockets 22 and contact one of the pads 30.

In use, one of the pads 30 is inserted into each of the pockets 22. The bra 12 is then position on the torso of the person so that the cups 14 of the bra 12 are positioned over the breasts 1 of the person. The covers 18 are then pivoted over the cups 14 to cover the feeding aperture 16 of each of the cups 14. The pads 30 positioned in the pockets 22 are positioned over and abutted against the nipples 2 when the covers 18 are positioned over the cups 14.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A nursing bra assembly comprising:

a bra for covering a pair of breasts and a portion of the torso of a person, said bra including a pair of cups, each of said cups covering a portion of an associated one of the breasts, each of said cups having a feeding aperture extending therethrough, wherein at least a nipple of the associated one of the breasts is accessible through the cup to be suckled by an infant;

a pair of covers, each of said cups of said bra having one of said covers pivotally coupled thereto, said covers being selectively pivoted over said feeding aperture in the associated one of said cups;

a pair of pockets, each of said covers having an interior face having one of said pockets coupled thereto, said pockets being positioned over and adjacent to said feeding aperture of the associated one of said cups when said covers are positioned over said feeding aperture, each of said pockets having an approximately centrally disposed insertion aperture extending therein; and a pair of pads, each of said pads being removably positioned in one of said pockets and being aligned with one of said feeding apertures, said insertion aperture permitting one of said pads to be inserted between the associated one of said pockets and the associated one of said covers to maintain positioning of the associated one of said pads, said insertion aperture permitting the nipple of the associated one of the breast to extend through the associated one of said pockets and contact one of said pads.

2. The assembly according to claim 1, wherein each of said covers includes a securing member configured to secure said covers over an associated one of said feeding apertures.

3. The assembly according to claim 1, wherein each of said pockets includes a peripheral edge coupled to an interior face of the associated one of said covers.

4. The assembly according to claim 1, wherein each of said pockets is comprised of an elastic mesh material to permit each of said insertion apertures to expand to receive one of said pads and said pockets to compress said pads against said covers.

5. A nursing bra assembly comprising:

a bra for covering a pair of breasts and a portion of a torso of a person, said bra including a pair of cups, each of said cups covering a portion of an associated one of the breasts, each of said cups having a feeding aperture extending therethrough, wherein at least a nipple of the associated one of the breasts is accessible through the cup to be suckled by an infant;

a pair of covers, each of said cups of said bra having one of said covers pivotally coupled thereto, said covers being selectively pivoted over said feeding aperture in the associated one of said cups, each of said covers including a securing member configured to secure said covers over an associated one of said feeding apertures;

a pair of pockets, each of said covers having one of said pockets coupled thereto, said pockets being positioned over and adjacent to said feeding aperture of the associated one of said cups when said covers are positioned over said feeding aperture, a peripheral edge of each of said pockets being coupled to an interior face of the associated one of said covers, each of said pockets having an approximately centrally disposed insertion aperture extending therein;

a pair of pads, each of said pads being removably positioned in one of said pockets and being aligned with one of said feeding apertures; and insertion aperture permitting one of said pads to be inserted between the associated one of said pockets and the associated one of said covers to maintain positioning of the associated one of said pads, each of said pockets being comprised of an elastic mesh material to permit each of said insertion apertures to expand to receive one of said pads and said pockets to compress said pads against said covers, said insertion aperture permitting the nipple of the associated one of the breast to extend through the associated one of said pockets and contact one of said pads.

* * * * *